US010563502B1

(12) United States Patent
Phillips et al.

(10) Patent No.: US 10,563,502 B1
(45) Date of Patent: Feb. 18, 2020

(54) ADVANCED SONDE RELIABILITY MONITORING, APPARATUS AND ASSOCIATED METHODS

(71) Applicant: Merlin Technology, Inc., Kent, WA (US)

(72) Inventors: Scott Phillips, Kent, WA (US); Timothy Bayliss, Maple Valley, WA (US); Thomas J. Hall, Bainbridge Island, WA (US)

(73) Assignee: Merlin Technology, Inc., Kent, WA (US)

( * ) Notice: Subject to any disclaimer, the term of this patent is extended or adjusted under 35 U.S.C. 154(b) by 79 days.

(21) Appl. No.: 15/711,830

(22) Filed: Sep. 21, 2017

Related U.S. Application Data

(60) Provisional application No. 62/398,708, filed on Sep. 23, 2016.

(51) Int. Cl.

| | |
|---|---|
| ***E21B 47/00*** | (2012.01) |
| ***E21B 41/00*** | (2006.01) |
| ***E21B 47/12*** | (2012.01) |
| ***E21B 45/00*** | (2006.01) |

(52) U.S. Cl.
CPC ..... *E21B 47/122* (2013.01); *E21B 45/00* (2013.01); *E21B 41/00* (2013.01)

(58) Field of Classification Search
CPC ..... E21B 47/122; E21B 45/00; E21B 41/00
See application file for complete search history.

(56) References Cited

U.S. PATENT DOCUMENTS

| | | | | |
|---|---|---|---|---|
| 6,005,532 | A | 12/1999 | Ng | |
| 6,496,008 | B1 | 12/2002 | Brune et al. | |
| 6,737,867 | B2 | 3/2004 | Brune et al. | |
| 6,727,704 | B2 | 4/2004 | Brune et al. | |
| 8,729,901 | B2 | 5/2014 | Lam et al. | |
| 9,274,243 | B2 | 3/2016 | Chau et al. | |
| 2002/0143421 | A1* | 10/2002 | Wetzer | G06Q 10/06 700/100 |
| 2011/0001633 | A1 | 1/2011 | Lam et al. | |
| 2013/0176139 | A1 | 7/2013 | Chau et al. | |
| 2014/0136423 | A1* | 5/2014 | Moreton | G06Q 30/012 705/302 |
| 2014/0152457 | A1* | 6/2014 | Nishisaka | E21B 47/12 340/853.2 |

* cited by examiner

*Primary Examiner* — Brad Harcourt
(74) *Attorney, Agent, or Firm* — Pritzkau Patent Group, LLC

(57) ABSTRACT

A sonde is receivable in a housing of an inground tool for transmitting an electromagnetic locating signal. The sonde is configured for monitoring a cumulative active run-time of its operation and for external transfer of the cumulative active run-time. A receiver receives the cumulative active run-time and provides at least one indication based on the cumulative active run-time.

22 Claims, 6 Drawing Sheets

ADVANCED SONDE RELIABILITY MONITORING, APPARATUS AND ASSOCIATED METHODS

RELATED APPLICATION

The present application claims priority from U.S. Provisional Patent Application No. 62/398,708 filed on Sep. 23, 2016 and which is hereby incorporated by reference in its entirety.

BACKGROUND

The present application is generally related to the field of horizontal directional drilling and, more particularly, to advanced sonde reliability monitoring, apparatus and associated methods.

While not intended as being limiting, one example of an application which involves the use of an inground device or transmitter is Horizontal Directional Drilling (HDD). The latter can be used for purposes of installing a utility without the need to dig a trench. A typical utility installation involves the use of a drill rig having a drill string that supports a boring tool, serving as one embodiment of an inground tool, at a distal or inground end of the drill string. The drill rig forces the boring tool through the ground by applying a thrust force to the drill string. The boring tool is steered during the extension of the drill string to form a pilot bore. Upon completion of the pilot bore, the distal end of the drill string is attached to a pullback apparatus which is, in turn, attached to a leading end of the utility. The pullback apparatus and utility are then pulled through the pilot bore via retraction of the drill string to complete the installation. In some cases, the pullback apparatus can comprise a back reaming tool, serving as another embodiment of an inground tool, which expands the diameter of the pilot bore ahead of the utility so that the installed utility can be of a greater diameter than the original diameter of the pilot bore.

Steering of a boring tool can be accomplished in a well-known manner by orienting an asymmetric face of the boring tool for deflection in a desired direction in the ground responsive to forward movement. In order to control this steering, it is desirable to monitor the orientation of the boring tool based on sensor readings obtained by sensors in a transmitter or sonde that is itself carried by a housing that forms part of the boring tool or other inground tool. The sensor readings, for example, can be modulated onto a locating signal that is transmitted by the transmitter for reception above ground by a portable locator or other suitable above ground device.

A sonde, in particular one that is housed in a boring tool, is often subjected to hostile conditions during drilling operations. These hostile conditions can include high levels of mechanical shock and vibration as well as high temperatures. These conditions can be exacerbated in certain drilling environments, such as drilling through rock. Applicants recognize that reliability of a sonde correlates with the number of hours a sonde is used during underground drilling.

However, measuring the use of a sonde underground is not straightforward. Total runtime is not an accurate measure, since a sonde may sit underground for hours without being used. Applicant has identified a need to measure run-time in a more accurate and useful manner, but without significantly increasing the complexity required to do so that could have the effect of hindering performance of the sonde and/or reliability of the measurement over time.

The foregoing examples of the related art and limitations related therewith are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

In general, an apparatus and associated method are described for use in a horizontal directional drilling system. In one aspect of the disclosure, the apparatus includes a sonde that is receivable in a housing of an inground tool for transmitting an electromagnetic locating signal. The sonde is configured for monitoring a cumulative active run-time thereof and for external transfer of the cumulative active run-time. A receiver receives the cumulative active run-time and provides at least one indication based on the cumulative active run-time.

In another aspect of the disclosure, a sonde forms part of an apparatus for use in a horizontal directional drilling system. The sonde includes a housing that is receivable in an inground tool for transmitting an electromagnetic locating signal. A processor is supported in the housing and is configured for monitoring a cumulative active run-time of the sonde and for external transfer of the cumulative active run-time to an above ground receiver that forms another part of the apparatus for providing at least one indication based on the cumulative active run-time.

BRIEF DESCRIPTIONS OF THE DRAWINGS

Example embodiments are illustrated in referenced figures of the drawings. It is intended that the embodiments and figures disclosed herein are to be illustrative rather than limiting.

Figure 3A:
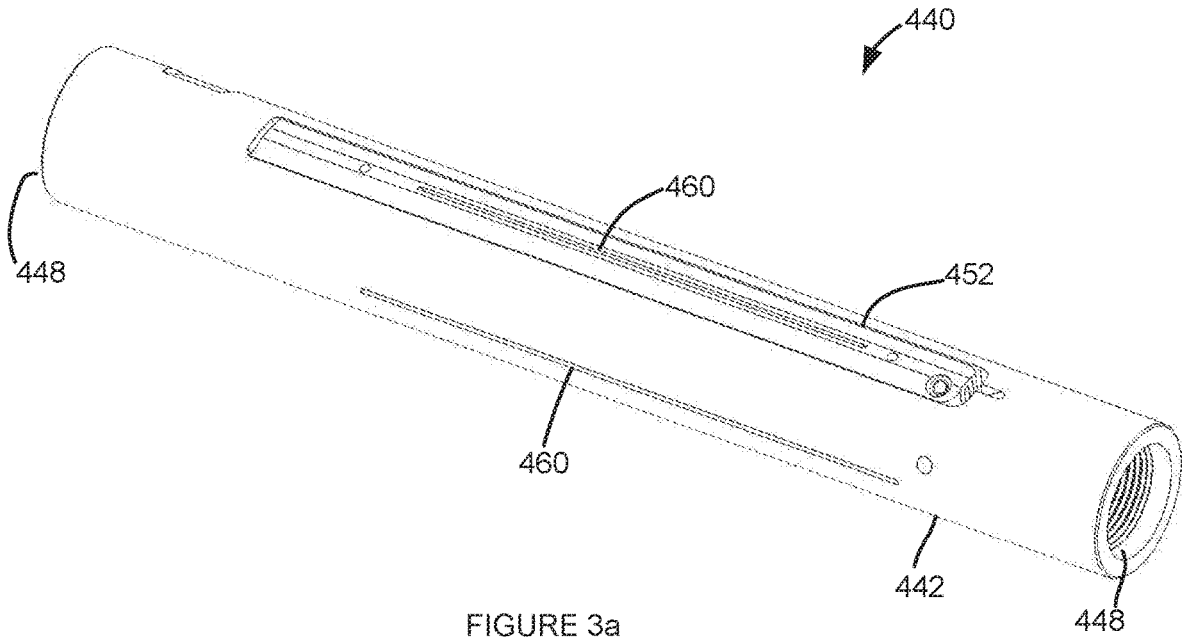

FIG. 3*a* is a diagrammatic view, in perspective, showing an embodiment of a housing for receiving an electronics package in accordance with the present disclosure.

Figure 3B:
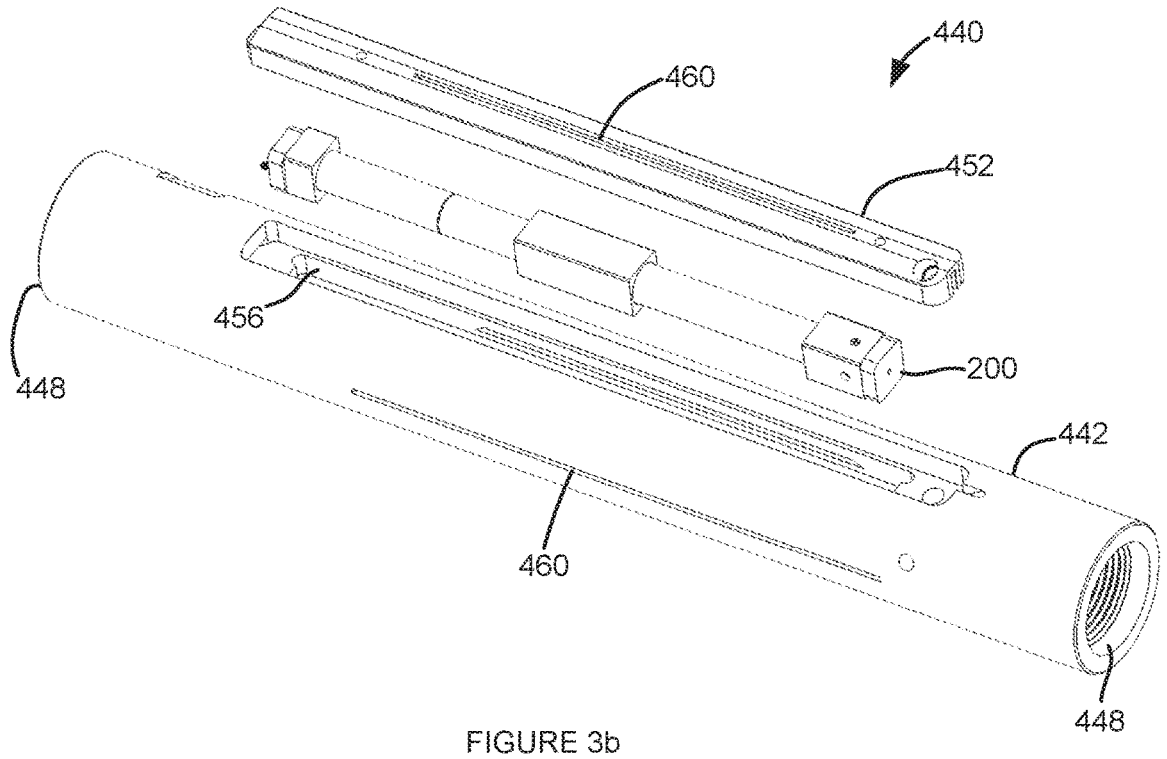

FIG. 3*b* is an exploded diagrammatic view, in perspective, showing the electronics package in relation to a housing cover and body.

Figure 4:
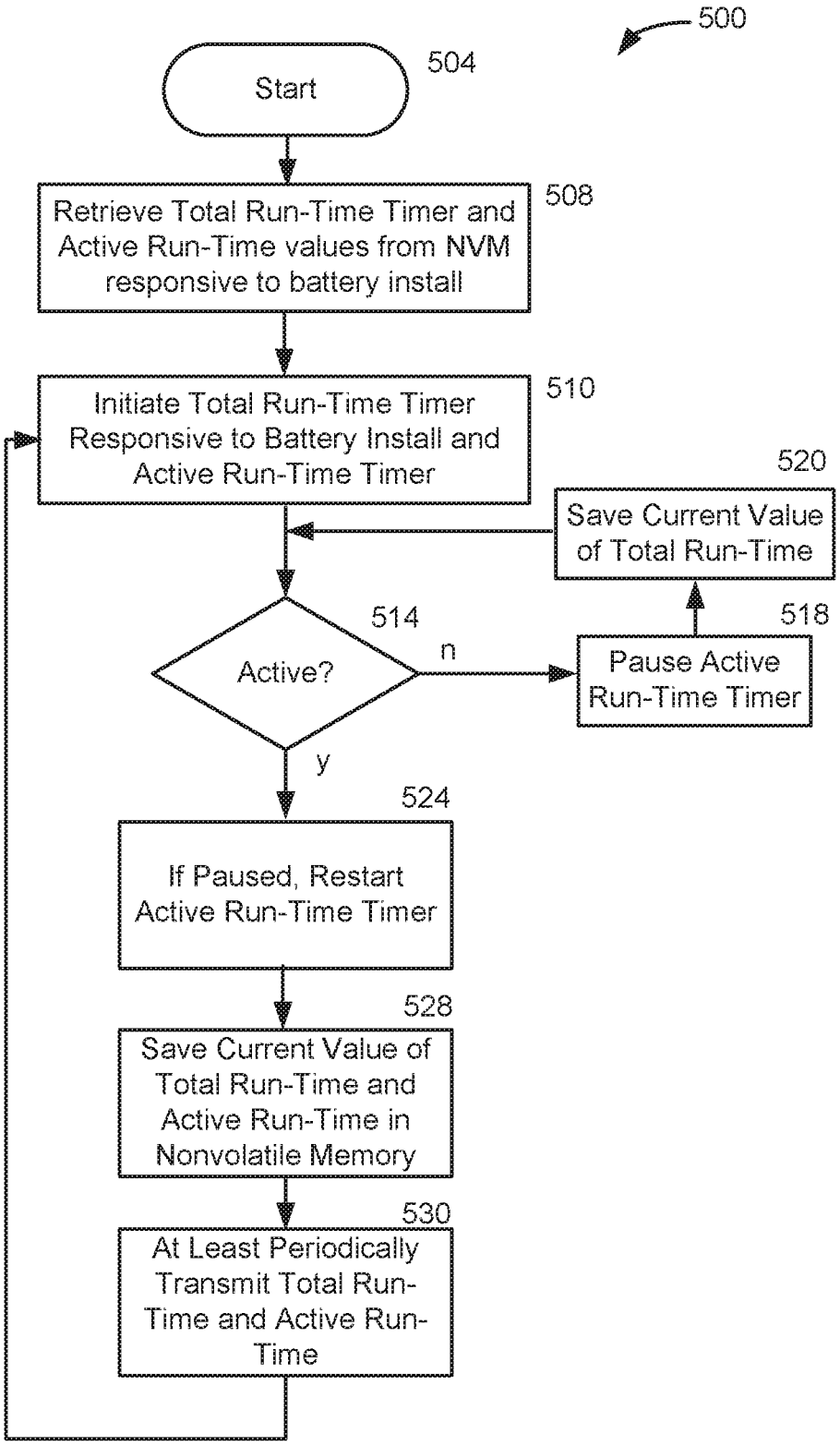

FIG. 4 is a flow diagram illustrating an embodiment of a method for operating an inground device in accordance with the present disclosure.

Figure 5:
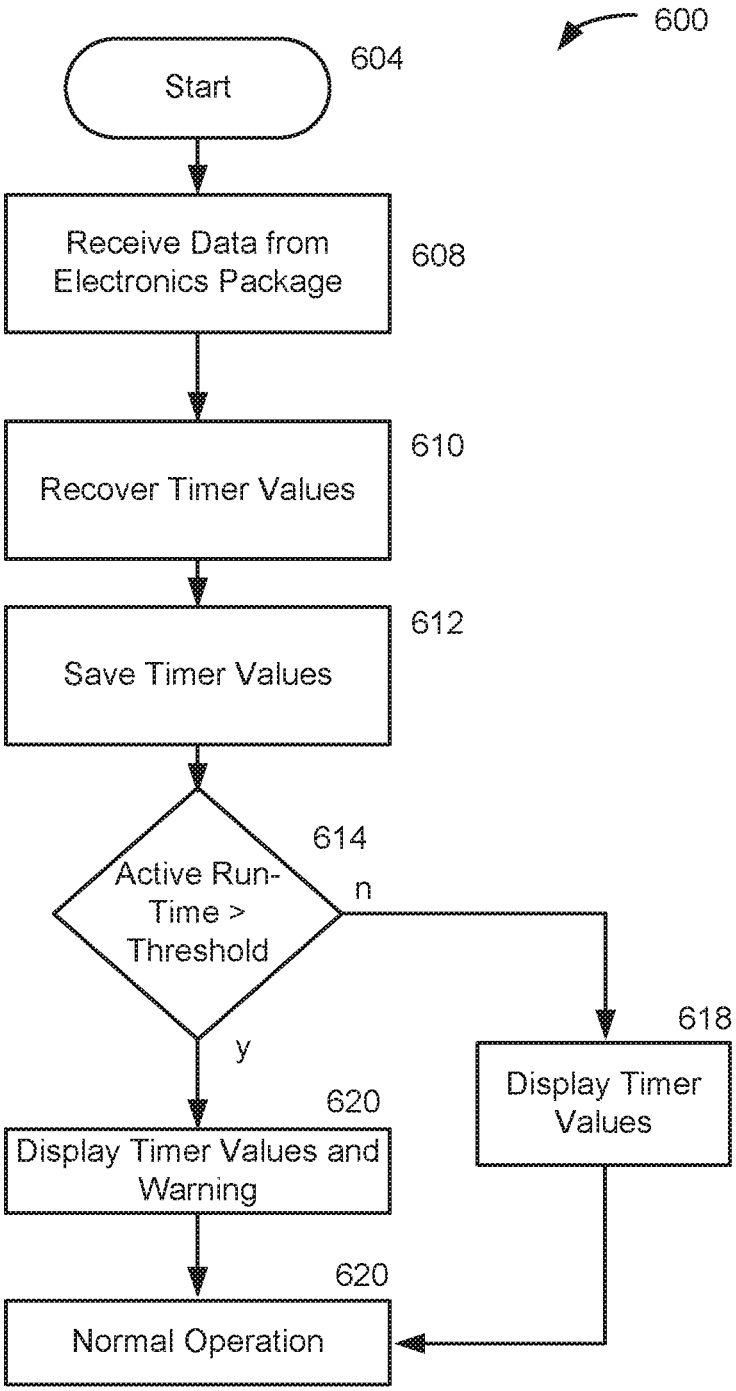

FIG. 5 is a flow diagram illustrating an embodiment of a method for operating a portable device in conjunction with the inground device in accordance with the present disclosure.

Figure 6:
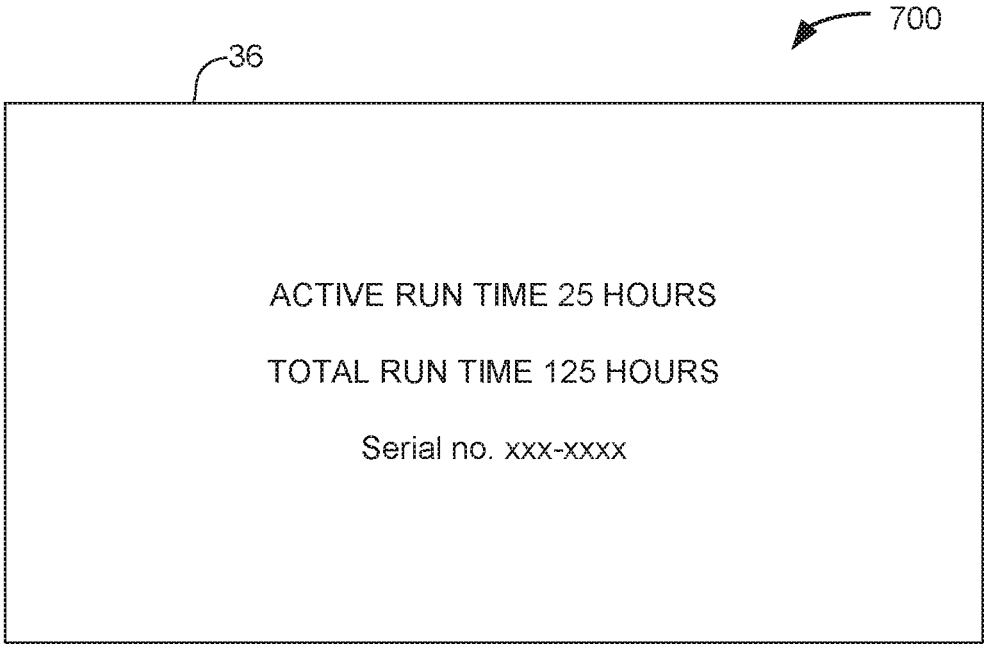
Figure 7:
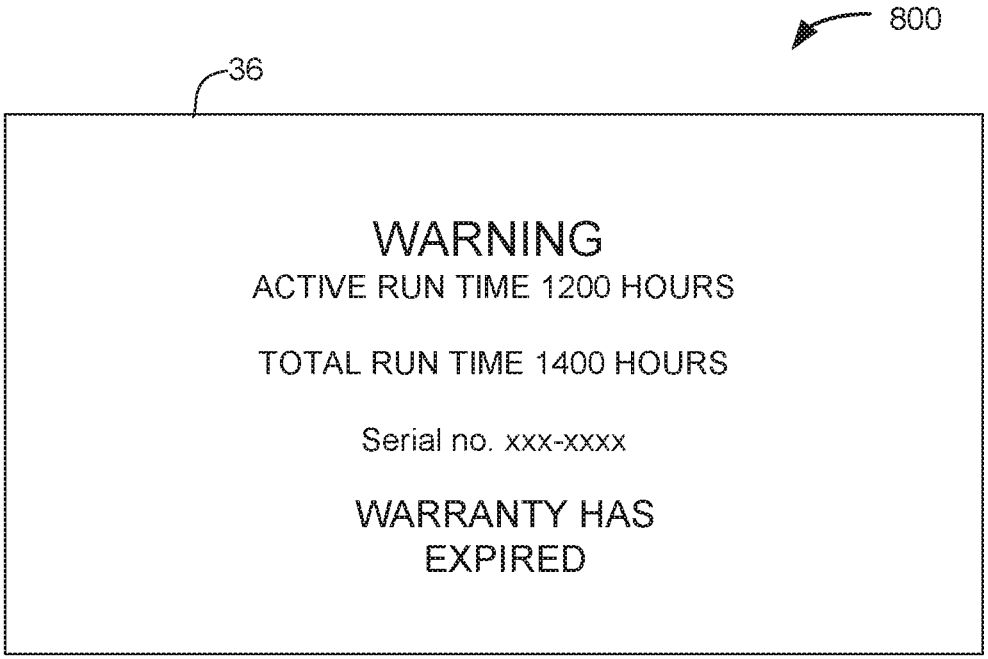

FIGS. 6 and 7 are screen shots illustrating two embodiments of the appearance of a display on the portable device.

DETAILED DESCRIPTION

The following description is presented to enable one of ordinary skill in the art to make and use the invention and is provided in the context of a patent application and its requirements. Various modifications to the described embodiments will be readily apparent to those skilled in the art and the generic principles taught herein may be applied to other embodiments. Thus, the present invention is not intended to be limited to the embodiments shown, but is to be accorded the widest scope consistent with the principles and features described herein including modifications and equivalents. It is noted that the drawings are not to scale and are diagrammatic in nature in a way that is thought to best illustrate features of interest. Descriptive terminology may be adopted for purposes of enhancing the reader's understanding, with respect to the various views provided in the figures, and is in no way intended as being limiting.

Figure 1:
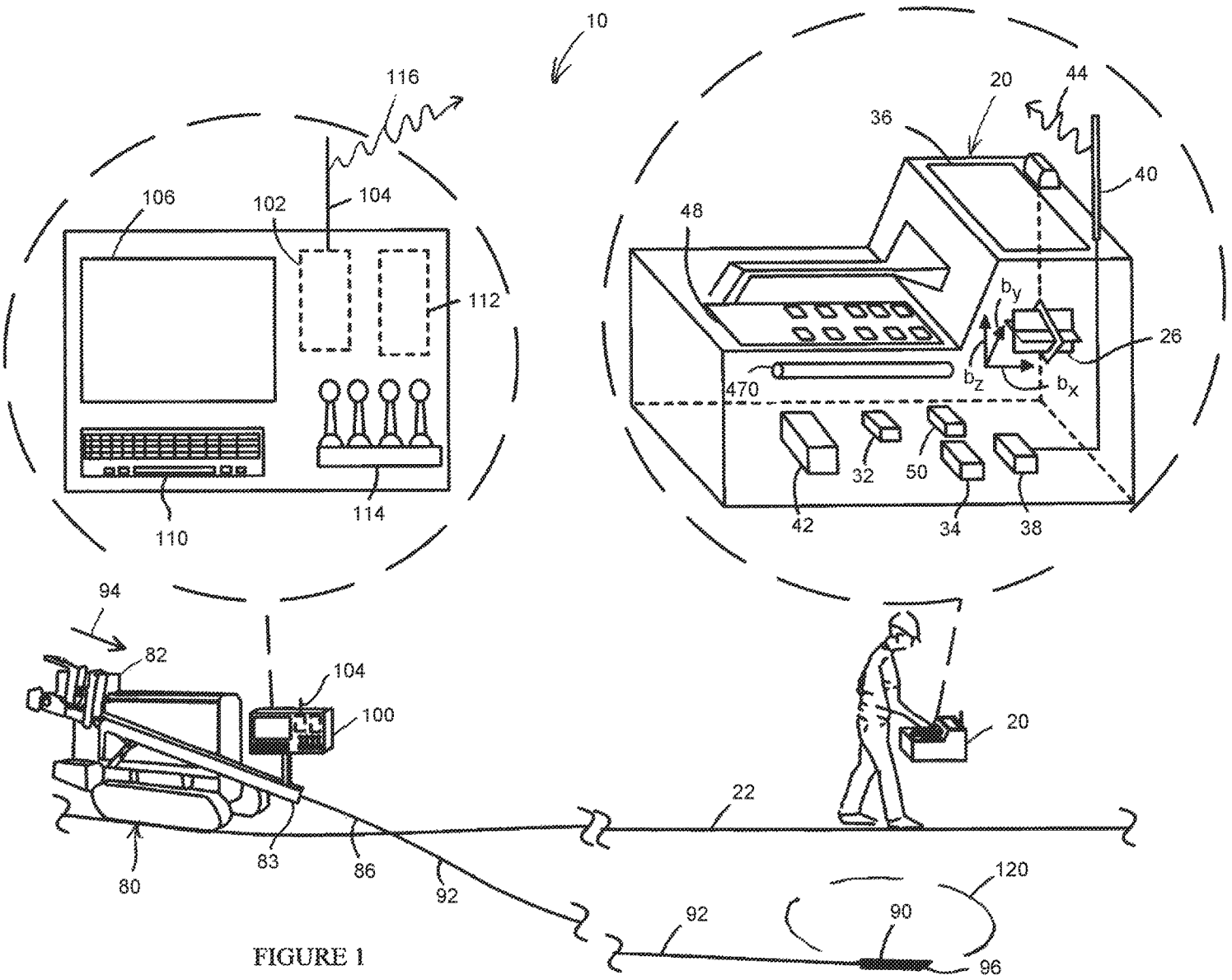
FIG. 1 is a diagrammatic view of an embodiment of a system for performing an inground operation in accordance with the present disclosure.

Turning now to the drawings, wherein like items may be indicated by like reference numbers throughout the various figures, attention is immediately directed to FIG. 1, which illustrates one embodiment of a system for performing an inground operation, generally indicated by the reference number 10. The system includes a portable device 20 that is shown being held by an operator above a surface 22 of the ground as well as in a further enlarged inset view. It is noted that inter-component cabling within device 20 has not been illustrated in order to maintain illustrative clarity, but is understood to be present and may readily be implemented by one having ordinary skill in the art in view of this overall disclosure. Device 20 includes a three-axis antenna cluster 26 measuring three orthogonally arranged components of magnetic flux indicated as $b_x$, $b_y$ and $b_z$. One useful antenna cluster contemplated for use herein is disclosed by U.S. Pat. No. 6,005,532 which is commonly owned with the present application and is incorporated herein by reference. Antenna cluster 26 is electrically connected to a receiver section 32. A tilt sensor arrangement 34 may be provided for measuring gravitational angles from which the components of flux in a level coordinate system may be determined.

Device 20 can further include a graphics display 36, a telemetry arrangement 38 having an antenna 40 and a processing section 42 interconnected appropriately with the various components. The telemetry arrangement can transmit a telemetry signal 44 for reception at the drill rig. The processing section can include a digital signal processor (DSP) or any suitable processor that is configured to execute various procedures that are needed during operation. It should be appreciated that graphics display 36 can be a touch screen in order to facilitate operator selection of various buttons that are defined on the screen and/or scrolling can be facilitated between various buttons that are defined on the screen to provide for operator selection. Such a touch screen can be used alone or in combination with an input device 48 such as, for example, a keypad. The latter can be used without the need for a touch screen. Moreover, many variations of the input device may be employed and can use scroll wheels and other suitable well-known forms of selection device. The processing section can include components such as, for example, one or more processors, memory of any appropriate type and analog to digital converters. As is well known in the art, the latter should be capable of detecting a frequency that is at least twice the frequency of the highest frequency of interest. Other components may be added as desired such as, for example, a magnetometer 50 to aid in position determination relative to the drill direction and ultrasonic transducers for measuring the height of the device above the surface of the ground.

Still referring to FIG. 1, system 10 further includes drill rig 80 having a carriage 82 received for movement along the length of an opposing pair of rails 83. An inground tool 90 is attached at an opposing end of a drill string 92. By way of non-limiting example, a boring tool is shown as the inground tool and is used as a framework for the present descriptions, however, it is to be understood that any suitable inground device may be used such as, for example, a reaming tool for use during a pullback operation or a mapping tool. Generally, drill string 92 is made up of a plurality of removably attachable drill pipe sections such that the drill rig can force the drill string into the ground using movement in the direction of an arrow 94 and retract the drill string responsive to an opposite movement. Each drill pipe section or rod can include a box fitting at one end and a pin fitting at an opposing end in a well-known manner. The drill pipe sections can define a through passage for purposes of carrying a drilling mud or fluid that is emitted from the boring tool under pressure to assist in cutting through the ground as well as cooling the drill head. Generally, the drilling mud also serves to suspend and carry out cuttings to the surface along the exterior length of the drill string. Steering can be accomplished in a well-known manner by orienting an asymmetric face 96 of the boring tool for deflection in a desired direction in the ground responsive to forward, push movement which can be referred to as a "push mode." Rotation or spinning of the drill string by the drill rig will generally result in forward or straight advance of the boring tool which can be referred to as a "spin" or "advance" mode.

The drilling operation is controlled by an operator (not shown) at a control console 100 (best seen in the enlarged inset view) which itself includes a telemetry transceiver 102 connected with a telemetry antenna 104, a display screen 106, an input device such as a keyboard 110, a processing arrangement 112 which can include suitable interfaces and memory as well as one or more processors. A plurality of control levers 114, for example, control movement of carriage 82. Telemetry transceiver 102 can transmit a telemetry signal 116 to facilitate bidirectional communication with portable device 20. In an embodiment, screen 106 can be a touch screen such that keyboard 110 may be optional.

Device 20 is configured for receiving an electromagnetic locating signal 120 that is transmitted from the boring tool or other inground tool. The locating signal can be a dipole signal. In this instance, the portable device can correspond, for example, to the portable device described in any of U.S. Pat. Nos. 6,496,008, 6,737,867, 6,727,704, as well as U.S. Published Patent Application no. 2011-0001633 each of which is incorporated herein by reference. In view of these patents, it will be appreciated that the portable device can be operated in either a walkover locating mode, as illustrated by FIG. 1, or in a homing mode having the portable device placed on the ground, as illustrated by the U.S. Pat. No. 6,727,704. While the present disclosure illustrates a dipole locating field transmitted from the boring tool and rotated about the axis of symmetry of the field, the present disclosure is not intended as being limiting in that regard.

Locating signal 120 can be modulated with information generated in the boring tool including, but not limited to position orientation parameters based on pitch and roll orientation sensor readings, temperature values, pressure values, battery status, tension readings in the context of a pullback operation, and the like. Device 20 receives signal 120 using antenna array 26 and processes the received signal to recover the data. It is noted that, as an alternative to modulating the locating signal, the subject information can be carried up the drill string to the drill rig using electrical conduction such as a wire-in-pipe arrangement. In another embodiment, bi-directional data transmission can be accomplished by using the drill string itself as an electrical conductor. An advanced embodiment of such a system is described in commonly owned U.S. application Ser. No.

13/733,097, now published as U.S. Published application Ser. No. 2013/0176139, which is incorporated herein by reference in its entirety. In either case, all information can be made available to console 100 at the drill rig.

Figure 2:
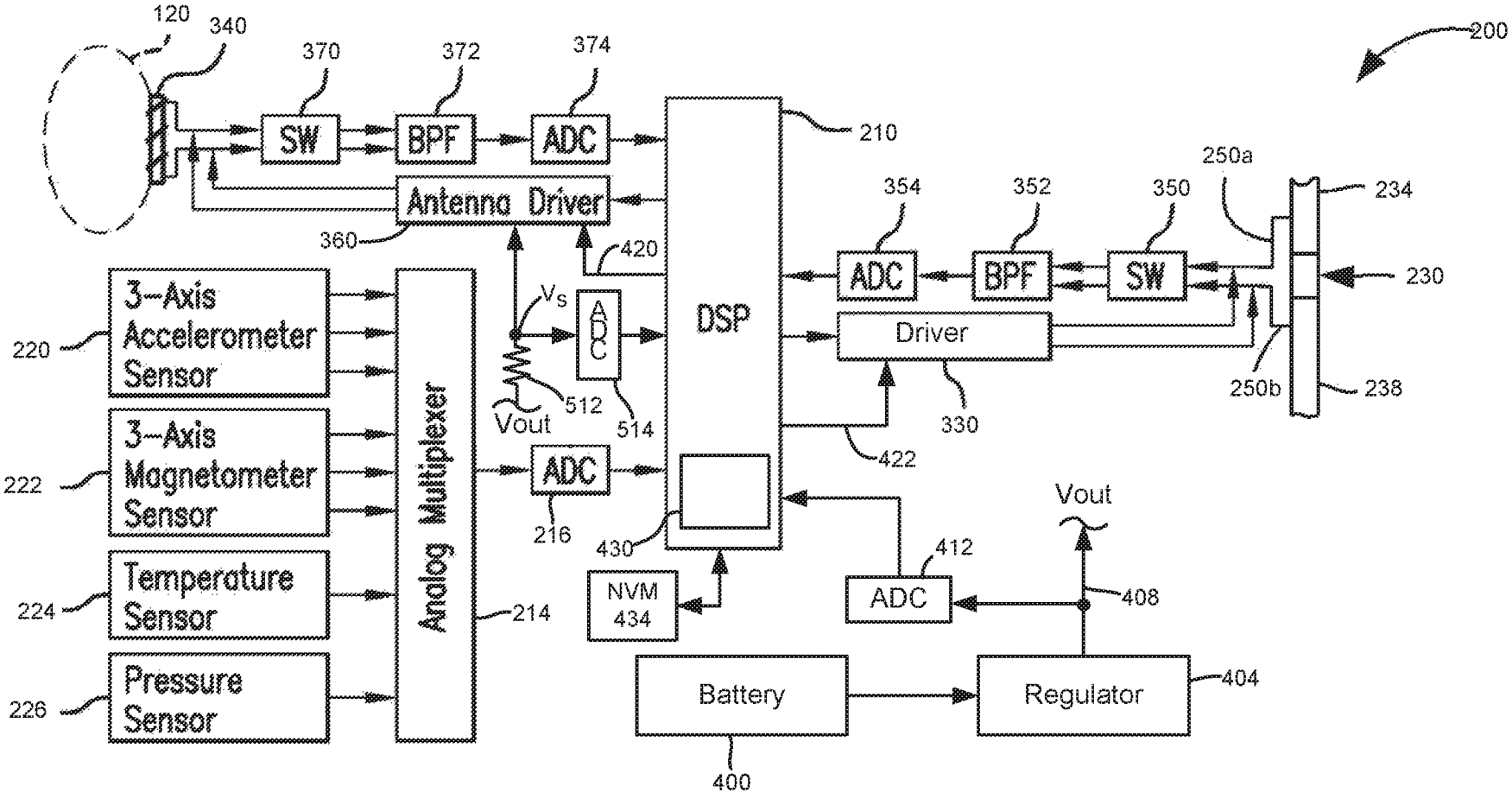
FIG. 2 is a block diagram that illustrates an embodiment of an electronics package (i.e., sonde) for use in an inground device or tool in accordance with the present disclosure.

FIG. 2 is a block diagram which illustrates an embodiment of an electronics package, generally indicated by the reference number 200, which can be supported by boring tool 90. The electronics package may be referred to interchangeably using the terms transmitter or transceiver. The electronics package can include an inground digital signal processor 210. A sensor section 214 can be electrically connected to digital signal processor 210 via an analog to digital converter (ADC) 216. Any suitable combination of sensors can be provided for a given application and can be selected, for example, from an accelerometer 220, a magnetometer 222, a temperature sensor 224 and a pressure sensor 226 which can sense the pressure of drilling fluid prior to being emitted from the drill string and/or within the annular region surrounding the downhole portion of the drill string. In an embodiment which implements communication to the drill rig via the use of the drill string as an electrical conductor, an isolator 230 forms an electrically isolating connection in the drill string and is diagrammatically shown as separating an uphole portion 234 of the drill string from a downhole portion 238 of the drill string for use in one or both of a transmit mode, in which data is coupled onto the drill string, and a receive mode in which data is recovered from the drill string. In some embodiments, the electrical isolation can be provided as part of the inground tool. The electronics section can be connected, as illustrated, across the electrically insulating/isolating break formed by the isolator by a first lead 250*a* and a second lead 250*b* which can be referred to collectively by the reference number 250. For the transmit mode, an isolator driver section 330 is used which is electrically connected between inground digital signal processor 210 and leads 250 to directly drive the drill string. Generally, the data that can be coupled into the drill string can be modulated using a frequency that is different from any frequency that is used to drive a dipole antenna 340 that can emit aforedescribed signal 120 (FIG. 1) in order to avoid interference. When isolator driver 330 is off, an On/Off Switcher (SW) 350 can selectively connect leads 250 to a band pass filter (BPF) 352 having a center frequency that corresponds to the center frequency of the data signal that is received from the drill string. BPF 352 is, in turn, connected to an analog to digital converter (ADC) 354 which is itself connected to digital signal processing section 210. In an embodiment, a DC blocking anti-aliasing filter can be used in place of a band pass filter. Recovery of the modulated data in the digital signal processing section can be readily configured by one having ordinary skill in the art in view of the particular form of modulation that is employed.

Still referring to FIG. 2, dipole antenna 340 can be connected for use in one or both of a transmit mode, in which signal 120 is transmitted into the surrounding earth, and a receive mode in which an electromagnetic signal such as a signal from an inground tool such as, for example, a tension monitor is received. For the transmit mode, an antenna driver section 360 is used which is electrically connected between inground digital signal processor 210 and dipole antenna 340 to drive the antenna. Again, the frequency of signal 120 will generally be sufficiently different from the frequency of the drill string signal to avoid interference therebetween. When antenna driver 360 is off, an On/Off Switcher (SW) 370 can selectively connect dipole antenna 340 to a band pass filter (BPF) 372 having a center frequency that corresponds to the center frequency of the data signal that is received from the dipole antenna. In an embodiment, a DC blocking anti-aliasing filter can be used in place of a band pass filter. BPF 372 is, in turn, connected to an analog to digital converter (ADC) 374 which is itself connected to digital signal processing section 210. Transceiver electronics for the digital signal processing section can be readily configured in many suitable embodiments by one having ordinary skill in the art in view of the particular form or forms of modulation employed and in view of this overall disclosure. A battery 400 provides electrical power to a voltage regulator 404. A voltage output, $V_{out}$, 408 can include one or more output voltage values as needed by the various components of the electronics package. The output voltage of battery 400 can be monitored, for example, by DSP 210 using an analog to digital converter 412. Control lines 420 and 422 from the DSP to drivers 360 and 330, respectively, can be used, for example, to customize locating signal 120 transmit power and/or drill string transmit power that is provided to isolator 230. The transmit power can be modified, for example, by changing the gain at which antenna driver 360 amplifies the signal that is provided from the DSP. The latter can implement a timer section 430 that monitors a clock 432 such as, for example, a system clock or oscillator. As will be further described, timer section can implement more than one timer. In an embodiment, one timer can track "total run-time" for package 200, which measures the total amount of time that the battery is installed in the transmitter, while another timer (or time calculation) can track "active run-time" for package 200, which equals the total amount of time that the battery is installed in the transmitter while the transmitter is not in a sleep mode or, in other words, is not active. It is noted that one characteristic of the active mode can be the transmission of data either by using the drill string as an electrical conductor and/or by transmitting locating signal 120. In some embodiments, a backup battery 433, shown in phantom using dashed lines, can provide continuous power to clock 432, the DSP and other components to maintain a real time clock that can be accessed by timer section 430. The DSP can access any suitable form of memory such as, for example, a non-volatile memory 434. The electronics package can be modified in any suitable manner in view of the teachings that have been brought to light herein.

Continuing to refer to FIG. 2, given that electronics package (which may be referred to interchangeably as a sonde) 200 is battery powered, it can be important to conserve battery power. In this regard, a depleted battery during an inground operation is a substantial inconvenience since accessing the electronics package would require the operator to trip the drill string and electronics package out the borehole, perhaps many hundreds of feet, replace the battery and then trip the electronics package back into the borehole. Accordingly, the electronics package can be configured with a battery conserving sleep mode that saves power, for example, at least by turning off transmission of locating signal 120. The sleep mode can be entered in any suitable manner. For example, the sleep mode can be entered based on accelerometer 220 readings which indicate that the package has been at rest for some period of time. In another embodiment, electronics package 200 can enter the sleep mode responsive to a command. The command can be issued and transmitted in any suitable way. For example, the command can be a roll orientation sequence that is detectable by DSP 210 monitoring outputs from accelerometer 220. In another embodiment, an operator can issue the command from portable device 20. The command can be transmitted directly to the electronics package via antenna 470 or transmitted by telemetry signal 44 to the drill rig and relayed to the electronics package through the drill string, used as an electrical conductor. The electronics package can also wake up from sleep mode in any suitable manner. For example, DSP 210 can detect movement such as a continuous change in roll orientation, based on readings from accelerometer 220 for some predetermined period of time. In another embodiment, the roll orientation can change by an amount that exceeds a threshold within some specified period of time.

Referring to FIGS. 3*a* and 3*b*, an embodiment of a housing arrangement is diagrammatically illustrated and generally indicated by the reference number 440. The housing arrangement includes a housing body 442 to which a drill head or other inground apparatus can be removably attached. By way of example, housing arrangement 440 can form part of inground tool 90 of FIG. 1. FIG. 3*a* is a diagrammatic assembled perspective view of the housing while FIG. 3*b* is a diagrammatic, partially exploded view, in perspective. Housing body 442 can define fittings such as, for example, the box and pin fittings that are used by the drill rods. In an embodiment, the housing body can define a box fitting 448 at each of its opposing ends. Housing arrangement 440 comprises what is often referred to as a side load housing. A housing lid 452 is removably receivable on the housing body. The housing body defines a cavity 456 for receiving electronics package 200. The housing body and housing lid can define a plurality of elongated slots 460 for purposes of limiting eddy currents that would otherwise attenuate the emanation of locating signal 120 (FIGS. 1 and 2) from within the housing arrangement or that would otherwise attenuate reception of an aboveground signal being transmitted from portable device 20 of FIG. 1 for reception by antenna 340 (FIG. 2) in the electronics package. The aboveground signal, for example, can be transmitted from a dipole antenna 470 that forms part of portable device 20.

Attention is now directed to FIG. 4 which illustrates an embodiment for the operation of electronics package 200 of FIG. 2, generally indicated by the reference number 500. Operation begins at start 504 and proceeds to 506 which retrieves a total run-time timer value and an active run-time timer value from nonvolatile memory (NVM) 434 (FIG. 2) responsive to power-up at battery installation. In an embodiment, each timer value can be stored in a register within the NVM of electronics package 200. At 508, the total run-time timer and active run-time timer values are retrieved and transferred, for example, to portable device 20 via any suitable communication path. For example, the transfer can be part of a pairing process in which electronics package 200 is paired with the portable device. It is noted that pairing and other above ground communication such as transferring the timer values can be accomplished using Bluetooth, infrared or using any other suitable above ground communication channel. As another example, the transfer can be performed by using the drill string as an electrical conductor to transfer the values to the drill rig and, thereafter, to portable device 20 via telemetry, if so desired. In still another example, the timer values can be modulated onto locating signal 120 for receipt by portable device 120. It is noted that both timer values can be initialized as zero at the time of manufacture of the electronics package. At 510, timer section 430 of FIG. 2 initiates a total run-time timer starting from the retrieved total run-time timer value and an active run-time timer starting from the retrieved active run-time timer value using clock 432 as a reference. It is noted that the total run-time timer continues to clock time so long as battery power is available. At 514, a decision is made as to whether electronics package 200 is active. In one embodiment, step 514 determines whether the transmitter is in a sleep mode (i.e., inactive) or awake (i.e., active). It is noted that electronics package 200 can enter the sleep mode and wake up therefrom in any suitable way. In an embodiment, the package can enter the sleep mode responsive to less than +/−5 degrees of rotation in 15 minutes. In an embodiment for waking up, the electronics package can become active responsive to greater than +/−60 degrees of rotation over some predetermined time interval. If the transmitter is not active, operation proceeds to 518 which pauses the active run-time timer. In an embodiment that uses a register value to track the active run-time, the result of step 518 can be to suspend any further register updates to the active run-time value until the active run-time timer is restarted. Operation then moves to 528 which saves the current value of the total run-time timer in NVM 434 and then operation returns to 514. On the other hand, if 514 detects that the transmitter is active, operation proceeds to 530 which restarts the active run-time timer, if it is paused. At 528, the current value of total run time and the current value of active run time are saved in NVM 434. At 530, the current value of total run time and the current value of active run time are transmitted in any suitable manner. The values can be used, for example, at the drill rig or by portable device 20. Using the latter by way of non-limiting example, the timer values can be transmitted by modulation on locating signal 120 to the portable device or transferred up the drill string to the drill rig and then relayed to the portable device via telemetry. It is noted that the timer values can at least initially be transferred, for example, to portable device 20 above ground, responsive to battery installation as modulation on locating signal 20, using Bluetooth, infrared or using any suitable above ground communication channel. When the electronics package is inground, transfer as modulation on locating signal 120 or through the drill string is appropriate. In another embodiment, the timer values can be transferred while package 200 is awake, for example, as part of step 528, although this is not required. It is noted that looping between steps 514 and 528 can continue until battery power is removed with the saved timer values being kept up to date by the process. It should be understood that the procedural steps shown in FIG. 4, as well as in any other flow diagram provided herein, can be reorganized or reordered in any suitable manner by one of ordinary skill in the art with this overall disclosure in hand.

Still referring to FIG. 4, another embodiment of step 514 will now be described. In this embodiment, step 514 does not determine whether the transmitter is in the sleep mode, but instead tests whether the transmitter is moving and, therefore, in active use based on sensor outputs. Applicants recognize that movement is detectable based on changing accelerometer outputs. Various aspects of transmitter movement generate accelerometer outputs including: 1) vibration, 2) changing the pitch orientation of the transmitter, 3) changing the roll orientation (i.e., spinning or rotation) of the transmitter, and 4) transitioning from a stationary state to forward or backward movement (i.e., starting to advance or retract the transmitter). Any suitable one or any suitable combination of accelerometer outputs associated with these forms of transmitter movement can be detected for purposes of determining whether the transmitter is active. Based on detecting movement, the method proceeds to 530 whereas a lack of detected movement routes operation to 518.

FIG. 5 is a flow diagram which illustrates an embodiment for the operation of portable device 20 or any suitable device that receives the timer values, generally indicated by the reference number 600. The method begins at start 604 and moves to 608 which receives data from the electronics package via any suitable communication path, as discussed above. At 610, timer values for the active run-time and total run-time are recovered, for example, during a pairing process or responsive to battery installation. At 612, the timer values can be saved in association with an identification of a specific electronics package. For example, the serial number of the electronics package can be transmitted along with the timer values. At 614, the active run-time is compared to a threshold value. The latter, for example, can represent an active run-time limit at which a warranty on the electronics package expires. Specifically, this indication may allow the manufacturer to offer a product warranty based on usage of the system (for example, exceeding an active run-time limit) as opposed to the more traditional warranty based on days elapsed from the date of shipment or purchase, which introduces the problem of a warranty potentially expiring while the product sits on a shelf and is not used. If the active run-time is less than the threshold, at 618, a screen can be displayed on display 36 of the portable device or other suitable device. An embodiment of the display screen is shown in FIG. 6, generally indicated by the reference number 700, and illustrates both active and total run-times along with the serial number of the electronics package, although there is no requirement to display this screen or all of the parameters that are shown.

If the decision at 614 determines that the threshold has been exceeded, operation proceeds to 620 which can display a different, warning screen on display 36 of the portable device or other suitable device. An embodiment of the display screen is shown in FIG. 7, generally indicated by the reference number 800, and shows both active and total run-times along with the serial number of the electronics package and a warning, although there is no requirement to display this particular screen or all of the parameters that are shown. In addition to enabling a product warranty based on usage, the measurement of active run-time can also be used to provide maintenance indications (for example, a recommendation to the customer to have the system serviced after exceeding an active run-time threshold), for analytics purposes (for example, tracking statistics such as average use per sonde, per model, per dollar spent) and for other similar purposes.

In view of the foregoing, system 10 is submitted to provide an elegant and heretofore unseen approach to monitoring and utilizing total run-time and active run-time of an inground electronics package. By apprising an operator of the values associated with each of active and total run times, the operator can avoid unnecessary risks associated with an inground package that has accumulated so many hours of use that it is out of warranty and less reliable.

The foregoing description of the invention has been presented for purposes of illustration and description. It is not intended to be exhaustive or to limit the invention to the precise form or forms disclosed, and other modifications and variations may be possible in light of the above teachings wherein those of skill in the art will recognize certain modifications, permutations, additions and sub-combinations thereof.

What is claimed is:

1. An apparatus for use in a horizontal directional drilling system, said apparatus comprising:

a sonde that is receivable in a housing of an inground tool for transmitting an electromagnetic locating signal, said sonde configured for monitoring a cumulative active run-time thereof and for external transfer of the cumulative active run-time, the sonde configured to enter a battery conserving sleep mode which turns off the electromagnetic locating signal and to pause incrementing of the cumulative active run-time during the sleep mode; and a receiver for receiving the cumulative active run-time and for providing at least one indication based on the cumulative active run-time.

2. The apparatus of claim 1 wherein the sonde transmits a serial number of the sonde at least with the cumulative active run-time and said receiver includes the serial number of the sonde as part of the indication.

3. The apparatus of claim 1 wherein the receiver compares the cumulative active run-time to a run-time threshold.

4. The apparatus of claim 3 wherein the receiver generates said indication as a warranty expired notification responsive to the cumulative active run-time exceeding the threshold.

5. The apparatus of claim 3 wherein the receiver generates said indication as a current value of the cumulative active run-time responsive to the cumulative active run-time being less than the threshold.

6. The apparatus of claim 1 wherein the sonde cooperates with the receiver during a pairing process to transfer the cumulative active run-time to the receiver.

7. The apparatus of claim 1 wherein the sonde is configured to transfer the cumulative active run time responsive to power-up.

8. The apparatus of claim 1 wherein the sonde is configured to modulate at least the cumulative active run time onto the electromagnetic locating signal and the receiver is configured to demodulate the locating signal to recover at least the cumulative active run-time.

9. The apparatus of claim 1 wherein the sonde includes a non-volatile memory and the sonde is configured to save the cumulative active run-time in the non-volatile memory.

10. The apparatus of claim 1 wherein said sonde is further configured to monitor a total run-time of the sonde and for external transfer of the total run-time and said receiver is configured to receive the total run-time and to include the total run-time in said indication.

11. The apparatus of claim 1 wherein the sonde transmits a serial number of the sonde at least with the cumulative active run-time.

12. An apparatus for use in a horizontal directional drilling system, said apparatus comprising:

a sonde that is receivable in a housing of an inground tool for transmitting an electromagnetic locating signal, said sonde configured for monitoring a cumulative active run-time thereof and for external transfer of the cumulative active run-time wherein the sonde includes a non-volatile memory and the sonde is configured to save the cumulative active run-time in the non-volatile memory and the sonde is configured to retrieve the cumulative active run-time from the non-volatile memory and to initialize a cumulative active run-time timer with the retrieved cumulative active run-time: and a receiver for receiving the cumulative active run-time and for providing at least one indication based on the cumulative active run-time.

13. A sonde forming part of an apparatus for use in a horizontal directional drilling system, said sonde comprising:

a housing that is receivable in an inground tool for transmitting an electromagnetic locating signal; and a processor supported in said housing and configured for monitoring a cumulative active run-time of the sonde, the processor configured to enter a battery conserving sleep mode which turns off the electromagnetic locating signal and to pause incrementing of the cumulative active run-time during the sleep mode and for external transfer of the cumulative active run-time to an above ground receiver that forms another part of the apparatus for providing at least one indication based on the cumulative active run-time.

14. The apparatus of claim 13 wherein the receiver compares the cumulative active run-time to a run-time threshold.

15. The apparatus of claim 14 wherein the receiver generates said indication as a warranty expired notification responsive to the cumulative active run-time exceeding the threshold.

16. The apparatus of claim 14 wherein the receiver generates said indication as a current value of the cumulative active run-time responsive to the cumulative active run-time being less than the threshold.

17. The sonde of claim 13 configured to cooperate with the receiver during a pairing process to transfer the cumulative active run-time to the receiver.

18. The sonde of claim 13 wherein said processor is configured to transfer the cumulative active run time responsive to power-up.

19. The sonde of claim 13 wherein the processor is configured to modulate at least the cumulative active run time onto the electromagnetic locating signal.

20. The sonde of claim 13 including a non-volatile memory and the processor is configured to save the cumulative active run-time in the non-volatile memory.

21. The sonde of claim 13 wherein said processor is further configured to monitor a total run-time of the sonde and for external transfer of the total run-time.

22. A sonde forming part of an apparatus for use in a horizontal directional drilling system, said sonde comprising:

a housing that is receivable in an inground tool for transmitting an electromagnetic locating signal;

a non-volatile memory; and a processor supported in said housing and configured for monitoring a cumulative active run-time of the sonde and saving the cumulative active run-time in the non-volatile memory and for external transfer of the cumulative active run-time to an above ground receiver that forms another part of the apparatus for providing at least one indication based on the cumulative active run-time and wherein the processor is configured to retrieve the cumulative active run-time from the non-volatile memory and to initialize a cumulative active run-time timer with the retrieved cumulative active run-time.

* * * * *